US005562458A

United States Patent [19]

Stora et al.

[11] Patent Number: 5,562,458

[45] Date of Patent: Oct. 8, 1996

[54] INTERFACE ENGAGEMENT AND LOCKING SYSTEM

[75] Inventors: Michael J. Stora, Boonton; Kevin P. Faith, Lake Hiawatha; Gerard J. Humphreys; Julian Pop, both of Boonton, all of N.J.; Thomas M. Dlugolecki, Mechanicsburg; Daniel T. Casey, Harrisburg, both of Pa.

[73] Assignee: The Whitaker Corporation, Wilmington, Del.

[21] Appl. No.: 363,174

[22] Filed: Dec. 23, 1994

[51] Int. Cl.[6] ..... H01R 13/62

[52] U.S. Cl. ..... 439/348; 439/953

[58] Field of Search ..... 439/348, 953

[56] References Cited

U.S. PATENT DOCUMENTS

| | | | |
|---|---|---|---|
| 3,917,331 | 11/1975 | Duran | 292/338 |
| 3,948,549 | 4/1976 | Duran | 292/26 |
| 3,980,327 | 9/1976 | Duran | 292/252 |
| 4,542,951 | 9/1985 | Mummey et al. | 339/75 M |
| 4,984,383 | 1/1991 | Mummey et al. | 439/259 |
| 5,073,127 | 12/1991 | Daly et al. | 439/473 |
| 5,105,095 | 4/1992 | Rudy, Jr. et al. | 307/17 |
| 5,310,352 | 5/1994 | Mroczkowski et al. | 439/76 |
| 5,340,255 | 8/1994 | Duran | 411/373 |
| 5,413,498 | 5/1995 | Ursich | 439/346 |

*Primary Examiner*—P. Austin Bradley
*Assistant Examiner*—T. C. Patel
*Attorney, Agent, or Firm*—Anton P. Ness

[57] ABSTRACT

An operating mechanism (50,182) for providing mechanical advantage for mating and unmating a fixture (10) to a receiver (150) manually at a separable interface for mating complementary arrays of electrical connectors (12,152) for use in testing equipment. The leading end (80,88) of the operating mechanism (50) of the fixture is inserted into a receptacle (182) of the receiver and locks to secure the fixture to the receiver, simultaneously unlocking a subassembly (58) within the operating mechanism to be manually rotated to fully mate the now-adjacent arrays of connectors. The subassembly (58) is movably secured within an outer barrel (54) affixed to a frame (20) of the fixture and includes an axially spring biased central shaft (70) movable within an inner barrel (72). Arrays of locking balls (76,82) within apertures 86,90) of the inner barrel move between annular grooves 78,84) of the central shaft (70) and annular grooves 186,142) of a surrounding cylinder (either the receptacle 182) or the outer barrel (54)) to lock and unlock the central shaft from being axially moved with respect to the particular surrounding cylinder. An acme screw (100) within the operating mechanism converts manual rotation of a handle (52) into gradual axial movement with substantially enhanced force.

25 Claims, 11 Drawing Sheets

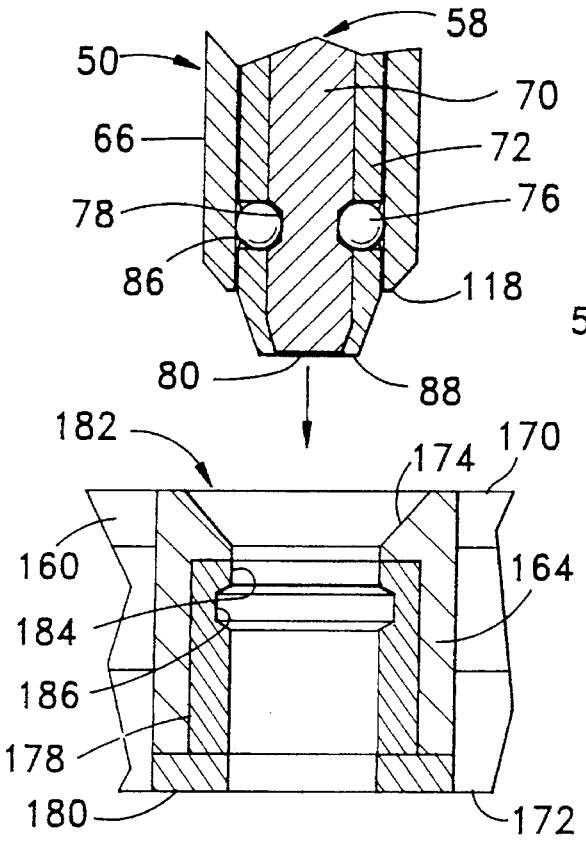
Fig. 8
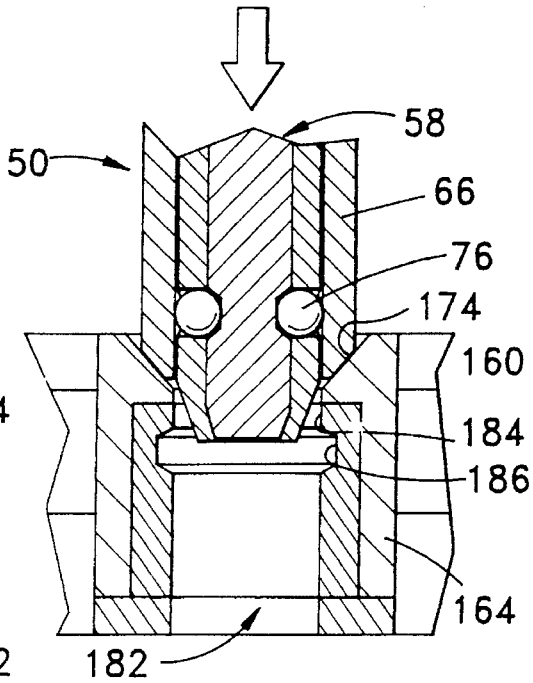
Fig. 9
Fig. 10
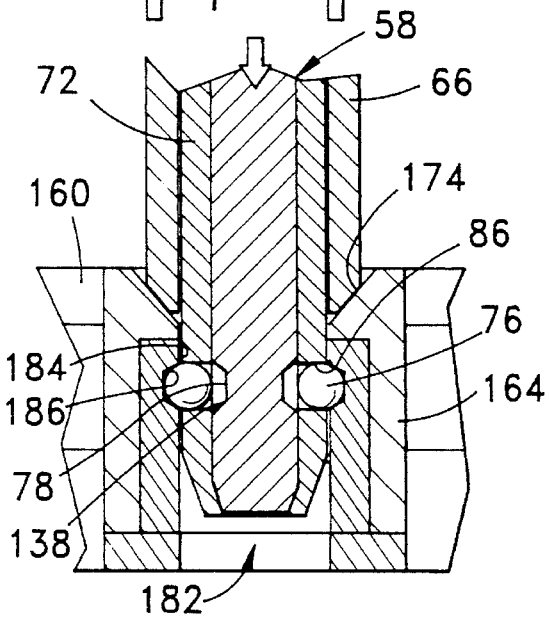
Fig. 11
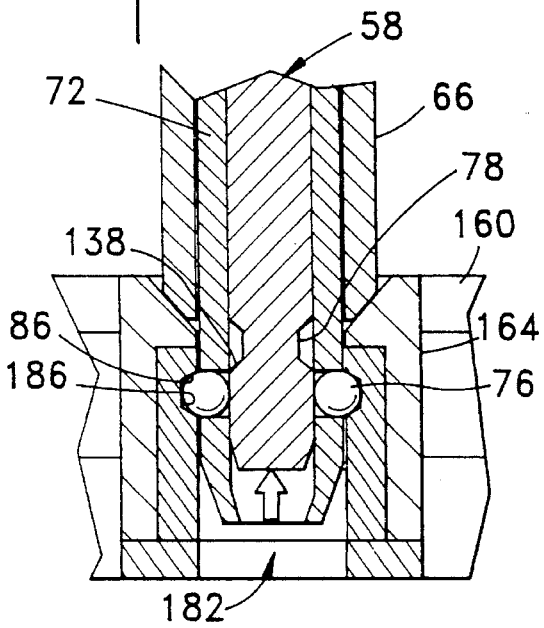

Fig. 15
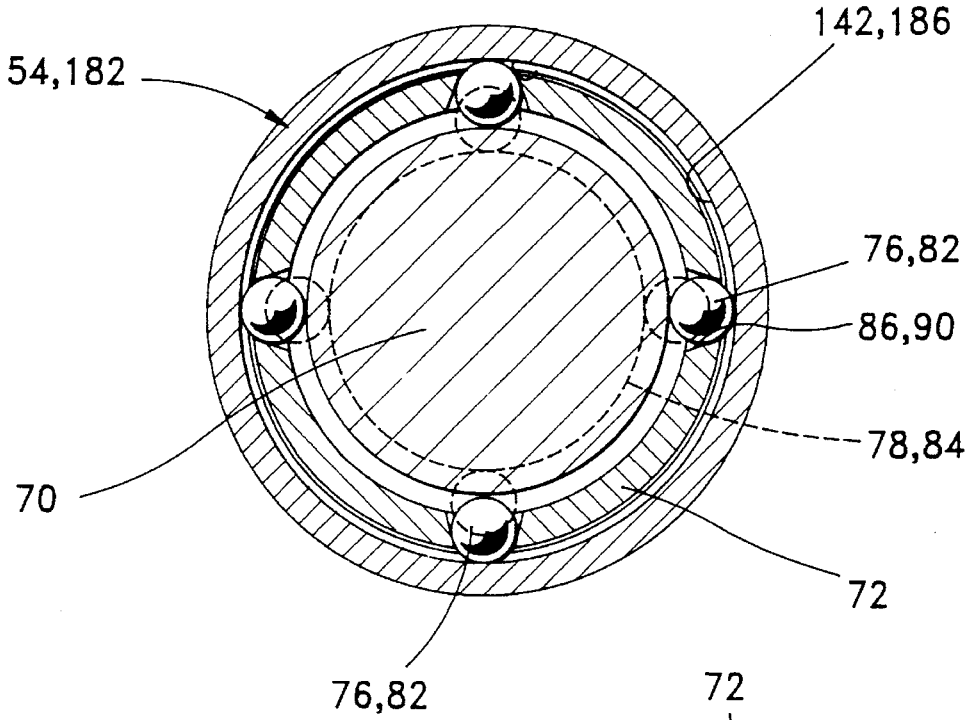
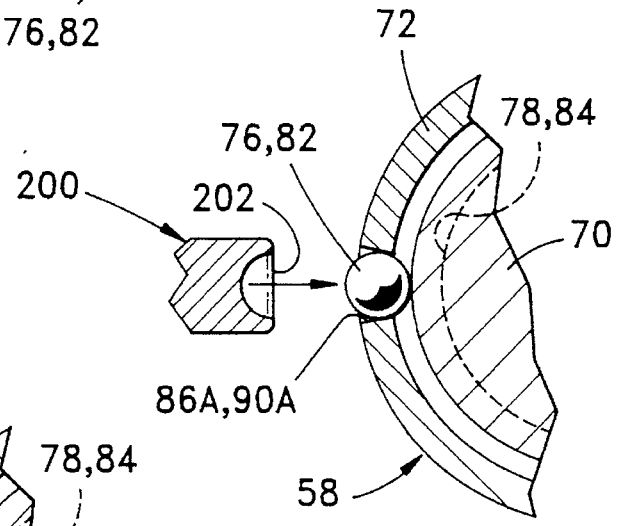
Fig. 16
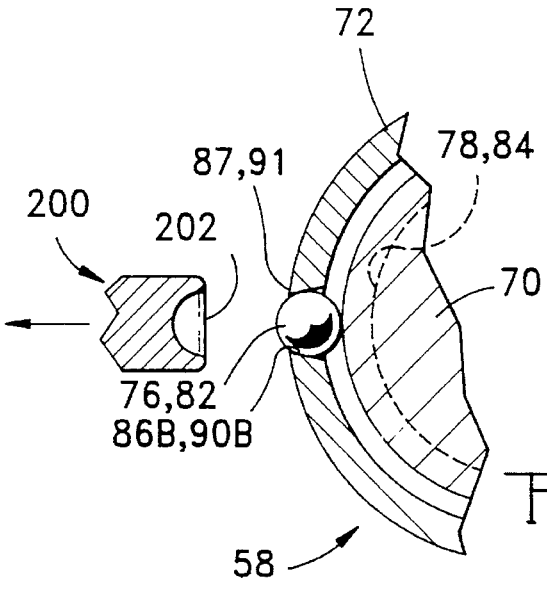
Fig. 17

INTERFACE ENGAGEMENT AND LOCKING SYSTEM

FIELD OF THE INVENTION

This relates to apparatus for securing and locking interfaces of two items releasably together and more particularly to apparatus for securing and locking together an array of electrical connectors mounted in a common frame to mating connectors in an electrically connected relationship permitting disconnection thereof, where the apparatus provides mechanical advantage overcoming resistance to mating and unmating.

BACKGROUND OF THE INVENTION

In electrical plugboard systems used in test equipment for testing electrical or electronic units, an array of electrical connectors are mounted in a frame to form a first panel and that contain arrays of selectively positioned electrical terminals terminating respective circuits, and the panel is then to be mated with a second panel that contains an array of electrical terminals matable with the connector terminals and that are connected to a computer, where the first panel's connector's terminals are interconnected defining circuits to program the test equipment upon mating with the second panel's terminals connected to the circuits of the computer. Commercially available mechanisms used to engage the mass of electrical interconnections along opposed mating faces, generally employ one of six conventional approaches to open and close the interconnection interfaces: (a) inclined plane; (b) jackscrew; (c) cammed pull/push action; (d) cammed lift action; (e) zero force insertion; and (f) vacuum techniques. For pin and socket terminal mating, approaches (a) through (c) are used, while for pin and spring tabs, approaches (d) and (e) are utilized that result in no insertion resistance as in pin and socket mating. Vacuum approach (f) is employed where spring-loaded pins are depressed by abutment against a mating contact surface.

An inclined plane approach is found in the "Series 90" products sold by Virginia Panel Corporation of Waynesboro, Va. A jackscrew technique is utilized in the "M Series" products sold by AMP Incorporated of Harrisburg, Pa. MAC Panel Company of High Point, N.C. sells "Series 120" products that incorporate a camming pull/push approach. "Universal Programming" products, also sold by AMP Incorporated, use a camming lift action technique, while "Linear and Rotary CAM ZIF PC Board Edge Connector" products of AMP Incorporated also use a "zero insertion force (ZIF)" mechanism. Finally, one example of the vacuum approach is applied in "In-Circuit" products of GenRad Incorporated of Concord, Mass.

These six methods have generally served the electronics industry satisfactorily for the particular contact densities involved heretofore. Increasingly, the electronics industry must provide interconnection arrangements with a greater number of contacts placed closer and closer together, having smaller sizes and with various of their parameters modified to result in high speed signal transmission. A greater pin count results in higher resistive forces during interface mating that must be overcome. Other areas of concern that need to be addressed in the connectors and in the securing apparatus therefor, are flexibility in the selection of the contact design, miniaturization of contacts, and signal transmission performance including signal integrity.

U.S. Pat. No. 4,542,951 discloses an operating mechanism for a plugboard system to connect and disconnect electrical terminals of a front bay with respective terminals of a rear bay, through linear movement. The operating mechanism includes hanger plates and sliding cam plates mounted on a rear frame, with the cam plates having profiled cam slots and L-shaped slots therein. An operating member is pivotally mounted into the rear frame to one side of the terminal array and includes rollers that are disposed in the L-shaped slots so that when the operating member is manipulated from one angular position to another, the rollers move along the L-shaped slots causing the cam plates to move along the rear frame, that causes the cam slots to linearly move support members on a front frame thereby connecting or disconnecting the electrical terminals.

U.S. Pat. No. 4,984,383 discloses a dual action operating mechanism for a plugboard system, wherein the mechanism first moves the front bay relative to the rear bay in a straight inward direction for connecting pin-and-socket ones of the terminals, and subsequently moving a subframe of the rear bay a preselected distance in a normal direction to connect coextending blade ones of the terminals, all through manipulation of a pivotally mounted operating member from one angular position to another.

In U.S. Pat. No. 5,310,352 is disclosed a high density electrical connector system for electrically interfacing contacts to contact pad surfaces under pressure. An assembly includes an array of connectors that are affixed to a common circuit board defining an interface with an array of contact pads exposed to be mated. The assembly is first moved with zero force to be adjacent a mating interface of an apparatus defined by an interposer, an assembly of a housing substrate containing an array of discrete contact members including contact portions protruding beyond the abutment or mating surface to be engaged by the contact pads of the circuit board of the assembly and urged into their respective cavities under spring bias, the contacts in turn defining electrical connections to circuits within the apparatus. An actuator of the assembly is rotatable after positioning the assembly in abutment against the interposer, with an end of a barrel of the actuator received into an apertures of the interposer. Rotation of the actuator cams interlocking sections of the barrel end into position along a cooperable locking surface within the apparatus to define a cinched or locked fully engaged position establishing assured contact normal force in a high density mating contact array, and that is easily unmated by rotation of the actuator to a disengaged position.

It is desired to provide a mechanism for magnifying manually applied forces to attain the substantial forces necessary to overcome the resistance to mating of a high density array of associated pairs of electrical contacts adapted to be mated upon axial movement, by moving the associated contacts axially into fully mated positions once the mating interfaces containing the arrays are proximate and aligned with each other.

It is also desired to provide such a mechanism that locks the mating interfaces in the fully mated position while permitting and facilitating unlocking and unmating thereof when desired.

SUMMARY OF THE INVENTION

The present invention provides a frame to which is secured an array of first electrical connectors containing respective first pluralities of electrical contacts to define a first or fixture assembly, and a second or receiver assembly including a frame secured to an apparatus and to which is secured an array of second electrical connectors containing respective second pluralities of electrical contacts. The fixture assembly is manipulatable to be placed into position adjacent the receiver assembly and includes an operating mechanism cooperable with a complementary section of the receiver assembly to move the fixture and receiver assemblies axially with respect to each other for mating, to lock the fixture assembly to the receiver assembly prior to connector mating, and to unlock the fixture and receiver assemblies for unmating and removal of the fixture assembly from the receiver assembly when desired.

The operating mechanism preferably includes a subassembly movably mounted within an outer housing or barrel affixed to the first frame, and preferably defining an acme screw mechanism selectively actuatable to move the subassembly axially relative to the outer barrel. The subassembly includes an inner shaft assembled within an inner housing or barrel in a manner permitting limited axial movement therewithin when unlocked, and the subassembly thus defined is rotatable within the outer barrel upon actuation of the acme screw mechanism by a manually grippable actuating section thereof after unlocking of an internal locking system. The internal locking system is releasable only upon full axial insertion of the leading end of the subassembly into the complementary receptacle of the receiver assembly resulting in locking of the fixture assembly to the receiver assembly against any further axial movement. Release of the internal locking system enables a manually grippable actuating section to be rotated in a first direction, in turn rotating the subassembly.

Preferably the panel locking system and the internal locking system are defined by a pair of arrays of locking balls disposed within the subassembly seated within respective apertures of the inner barrel. The locking balls of each array are movable radially within their inner barrel apertures reciprocally between a respective annular groove or raceway of the central shaft, and an annular groove in the inner surface of a cylinder surrounding the inner barrel thereat, the cylinder being either the receptacle of the receiver (for the panel locking system) or the outer barrel (for the internal locking system). Such reciprocal locking ball movement serves to lock and release the central shaft to permit axially repositioning the central shaft between two axial positions.

During mating, rotation by the actuating section of the subassembly with respect to the outer barrel upon release of the internal locking system, actuates the acme screw mechanism operable between the subassembly and the outer barrel, to incrementally move the fixture assembly continuously toward the receiver assembly until the pluralities of first electrical terminals become electrically engaged or mated with the pluralities of second electrical terminals, until the fixture assembly is brought into a final, fully mated position. Rotation of the actuating section in the reverse direction a predetermined angular distance, results in incremental movement of the fixture assembly from the receiver assembly, unmating the pluralities of terminals, whereafter the operating mechanism of the fixture assembly is unlockable from the complementary section of the receiver assembly. This system provides mechanical advantage to generating requisite forces necessary to overcoming the resistance to mating of the pluralities of first and second electrical terminals.

It is an objective of the present invention to provide all operating system for mating an assembly of electrical connectors with significant mechanical advantage thereby minimizing the manual force required.

It is another objective to provide such a system that assuredly locks together the panels for mating of the connectors in a manner that permits and facilitates unmating and unlocking when desired.

It is still another objective to provide such a system that accomplishes the locking and the unlocking, and the mating and the unmating, by manipulation of an actuator system without the use of tools.

It is further an objective for the operating mechanism to provide a panel locking system that is adapted to operate to lock merely upon full insertion of the leading end of the subassembly into a receptacle of the receiver, and to be easily unlockable by manipulation of the actuating section.

It is still further an objective for the operating system to provide an internal locking system that is adapted to operate to unlock merely upon locking of the panel locking system, and to be easily lockable by manipulation of the actuating section.

It is yet another objective to provide such a system that is highly durable with minimum risk of actuator binding or failure.

An embodiment of the present invention will now be described by way of example with reference to the accompanying drawings.

BRIEF DESCRIPTION OF THE DRAWINGS

FIG. 3 is an exploded view of the receiver assembly of FIG. 1;

FIGS. 8 to 11 are enlarged section views of the work end of the operating mechanism of FIG. 7 shown prior to, during and following insertion thereof into the complementary receptacle of the receiver assembly, for locking the fixture assembly to the receiver assembly;

FIG. 15 is a cross-sectional view of the locking ball arrays and apertures and raceways therefor at both the panel locking site and the interior locking site; and FIGS. 16 and 17 are enlarged partial views of a ball site in the subassembly of the operating mechanism, showing during assembly thereof the swaging of the outer periphery of a ball-containing aperture of the inner barrel to secure the respective ball in the subassembly.

DETAILED DESCRIPTION OF THE PREFERRED EMBODIMENT

Figure 1:
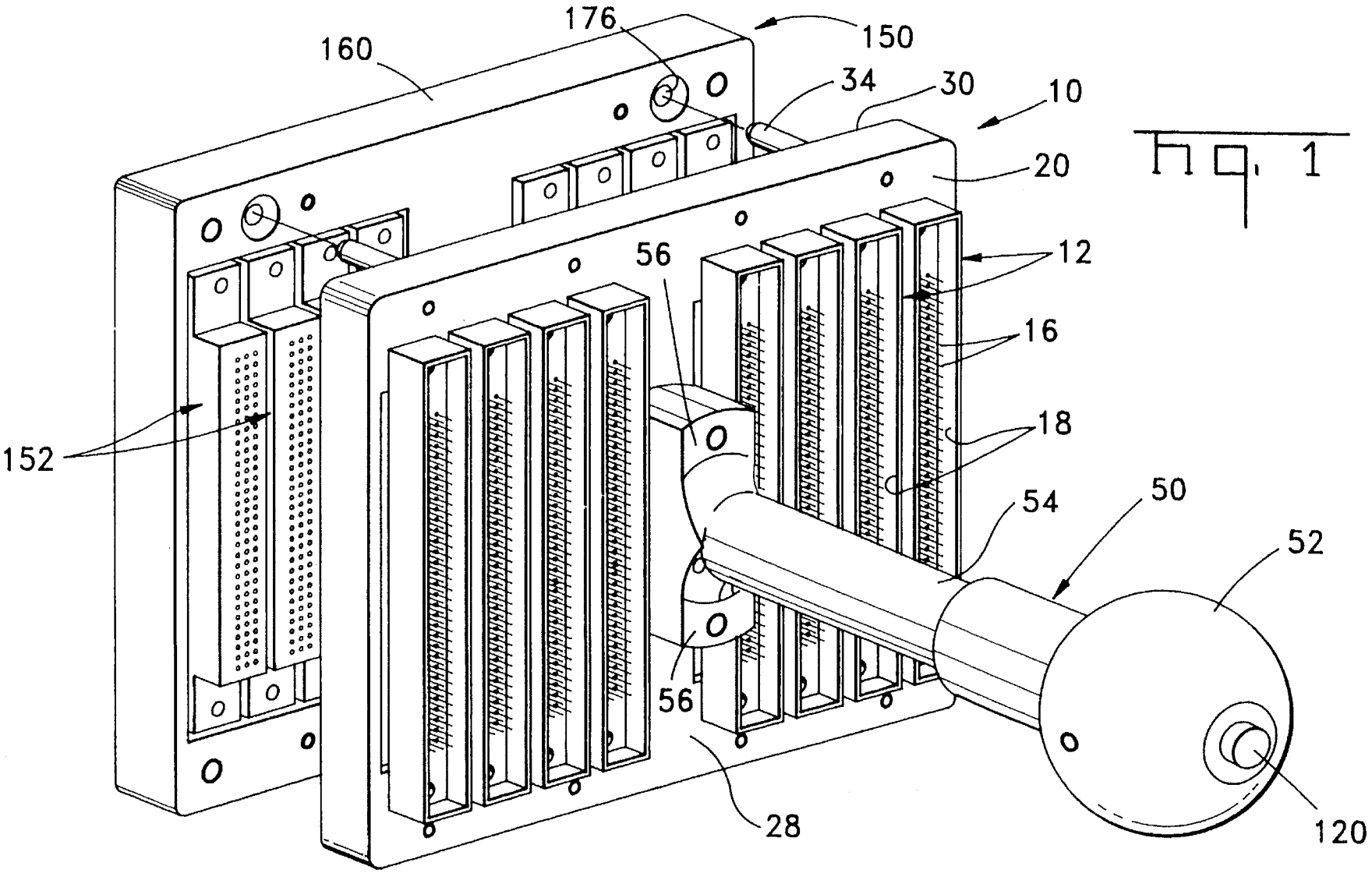
FIG. 1 is an isometric view of an interface system including an operating mechanism of the fixture assembly spaced from the receiver assembly of the present invention.

In FIG. 1 is seen a first or fixture assembly 10 including an operating mechanism 50 of the present invention, aligned to be mated with a second or receiver assembly 150.

Receiver assembly 150 would in practice be mounted to framework of test equipment apparatus (not shown), for example, and electrically connected to a test system thereof. Fixture assembly 10 includes an array of electrical connectors 12 mounted to a transverse frame 20 to permit incremental lateral float and housing respective pluralities of electrical terminals 16 terminated to conductors such as wires (not shown) interconnecting the terminals to selected others thereof in a plugboard arrangement for facilitating signal transmission between the unit-under-test and the test equipment to perform specific functions as desired. Receiver assembly 150 includes complementary connectors 152 secured in a transverse common frame 160 and containing corresponding pluralities of electrical terminals 156 (FIG. 3) matable with terminals 16 (FIG. 2) of connectors 12 of fixture assembly 10 to establish the interconnections therewith and accomplish the signal transmission between the unit-under-test and the test equipment.

Figure 2:
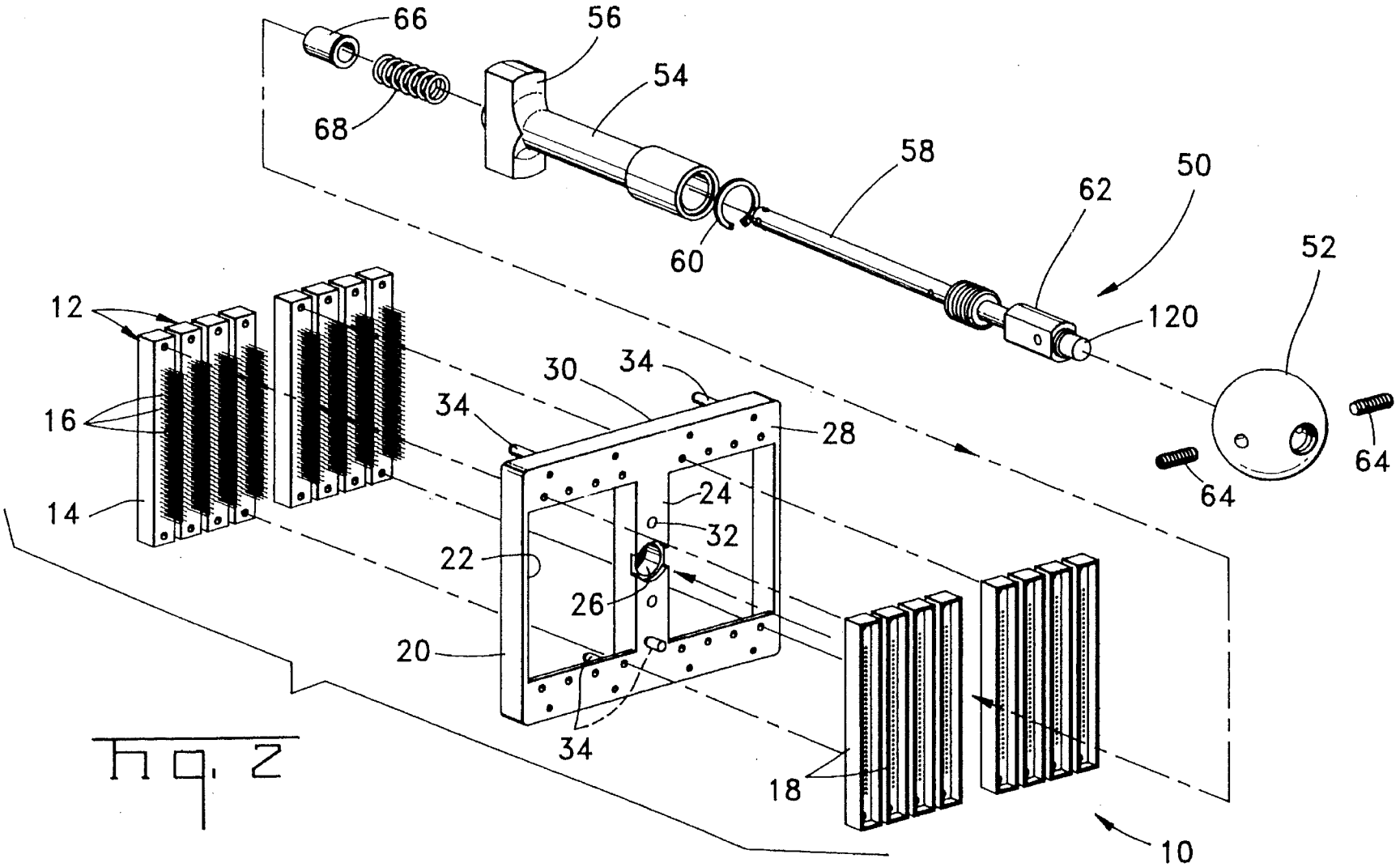
FIG. 2 is an exploded view of the fixture assembly of FIG. 1 showing the components of the operating mechanism.

As seen in FIG. 2, connectors 12 include at least forward housing members 14 and also preferably include rearward housing or shroud sections 18. Connectors 12 are disposed in large cavities 22 defined by the frame's side walls and cross bar 24, with mounting flanges of the housings being affixed such as by bolts or screws to mounting ledges of frame 20. A central aperture 26 is provided through cross bar 24 extending between an assembly face 28 and mating face 30. A pair of mounting holes 32 are provided for attachment of operating mechanism 50 to frame 20. Also shown are alignment posts 34 selectively positioned about the periphery of frame 20 to extend forwardly from mating surface 30.

Operating mechanism 50 includes an actuating section, preferably a manually grippable handle 52, shown as spherical, and an outer housing or barrel 54 firmly secured at mounting flanges 56 to cross bar 24 of frame 20. Operating mechanism 50 includes subassembly 58 securable within outer barrel 54 by C-clip 60 seated within an annular seat or groove at the rearward end of the outer barrel. Subassembly 58 has an enlarged rearward end 62 extending rearwardly beyond the rearward end of outer barrel 54 and is securable within handle 52 such as by a pair of opposed set screws 64 that together cooperate with handle 52 to prevent axial and rotational movement of subassembly 58 with respect to handle 52. Disposed at the forward end of outer barrel 54 is a protective or ball capture sleeve 66 associated with a sleeve biasing mechanism such as a compression spring 68, part of the panel locking system explained with respect to FIG. 5.

In FIG. 3 is shown the receiver assembly 150 containing connectors 152 mounted to frame 160 and containing arrays of terminals 156. Connectors 152 include at least a main housing 154 and also preferably include a second housing member 158. Frame 160 includes opposing sidewalls and a cross bar 164 that together define large cavities 162 within which connectors 152 are contained by being affixed at mounting flanges 166 thereof by conventional bolts or screws to mounting ledges of frame 160. Through the center of cross bar 164 is an aperture 168 extending from mating face 170 to second face 172 of frame 160 and including a tapered leadin defining an entrance, whereby aperture 168 is adapted to receive thereinto the work end of the operating mechanism 50 of the fixture assembly 10. Selectively located about the periphery of mating surface 170 are alignment apertures 176 associated with alignment posts 34 of frame 20 of fixture assembly 10. Alignment apertures 176 include tapered entrances defining leadins, whereby leading ends of the alignment posts are received and bear against the leadins until centered with respect to alignment apertures 176, being incrementally transversely repositioned for frame 20 and fixture assembly 10 to become aligned with respect to receiver assembly 150. Such alignment is in order to align the connectors and their contacts prior to any physical engagement therebetween in order to protect them from damage due to any engagement when misaligned. Preferably the alignment posts and apertures are arranged asymmetrically to polarize the mating faces so that only one orientation can successfully lead to mating. Mounted within aperture 168 is a tubular member 178 that is secured to frame 160 by a mounting plate 180, with tubular member 178 together with aperture 168 forming a receptacle 182 containing the panel locking site.

Figure 4:
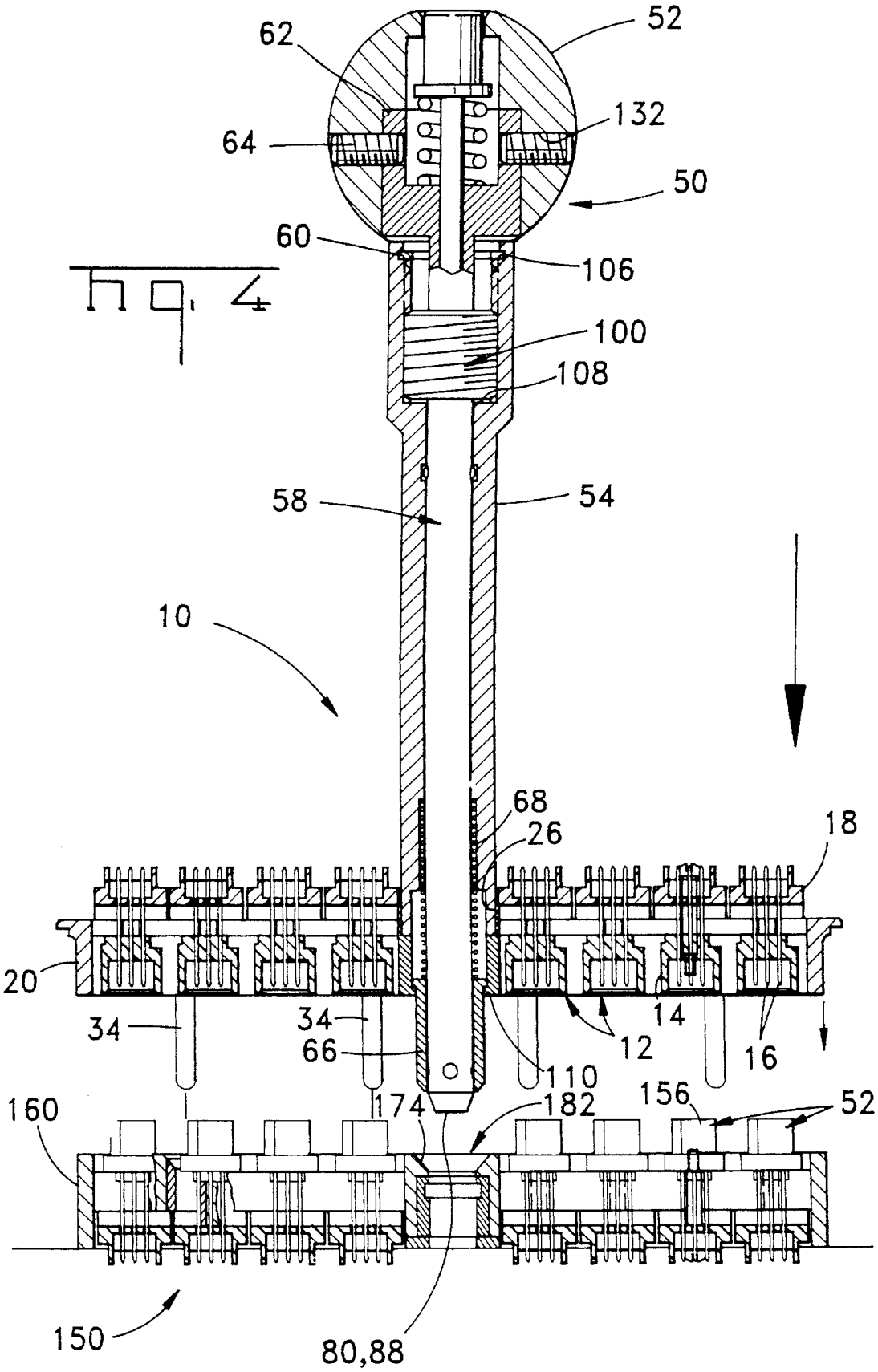
FIGS. 4 to 6 are sectional views of the fixture and receiver assemblies prior to engagement, engaged with connectors unmated, and fully mated respectively.
Figure 5:
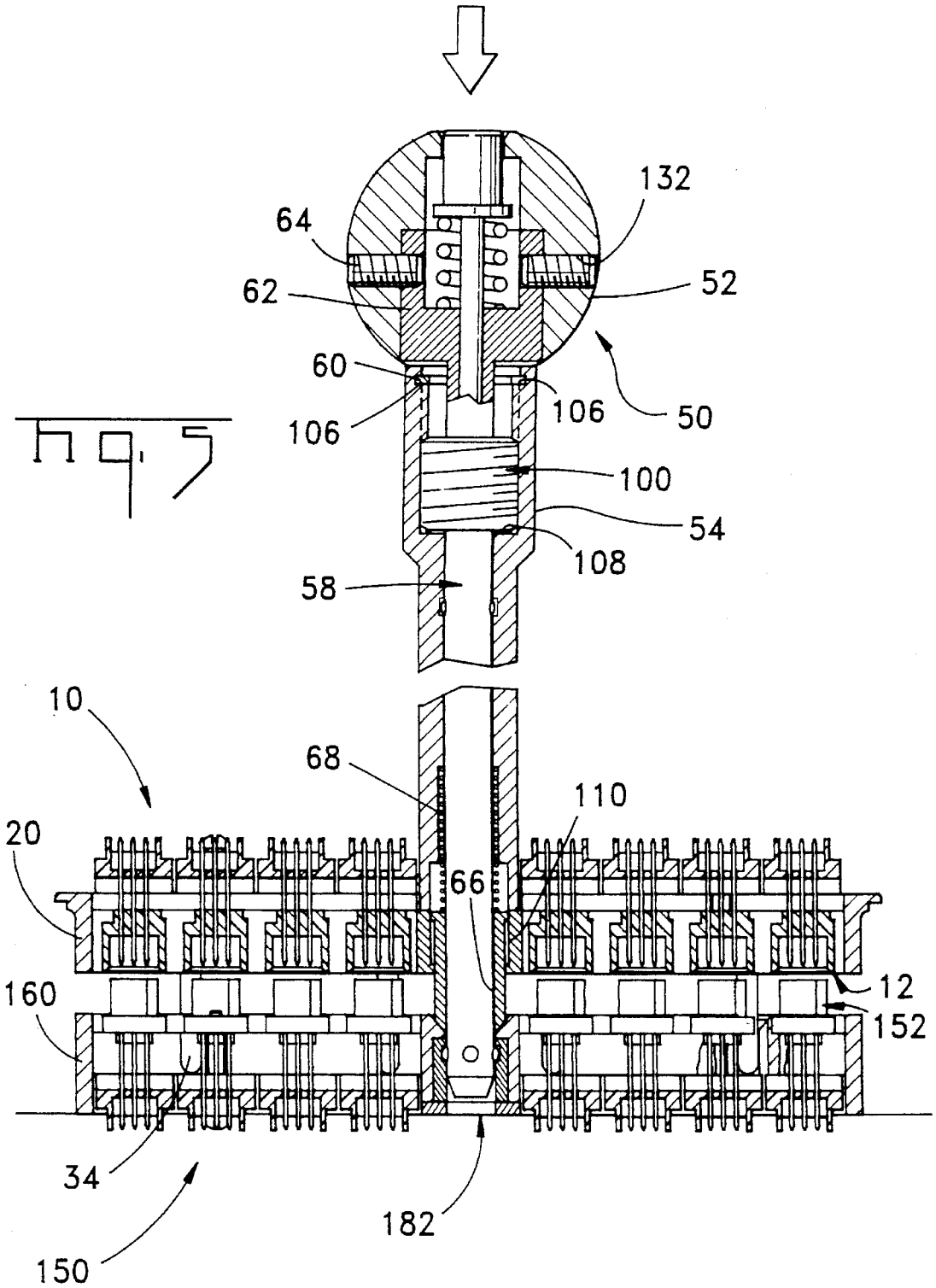
Figure 6:
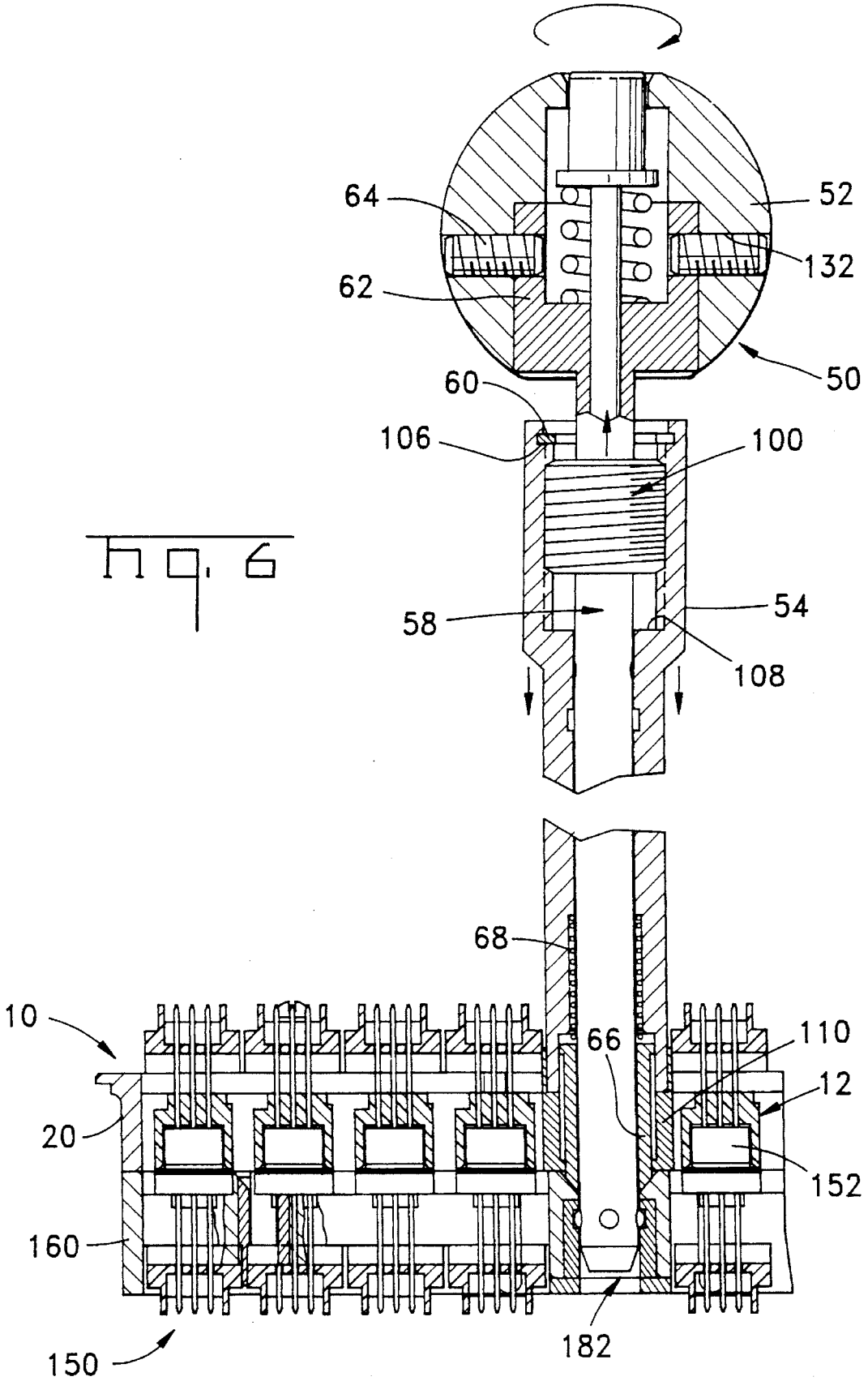
Figure 7:
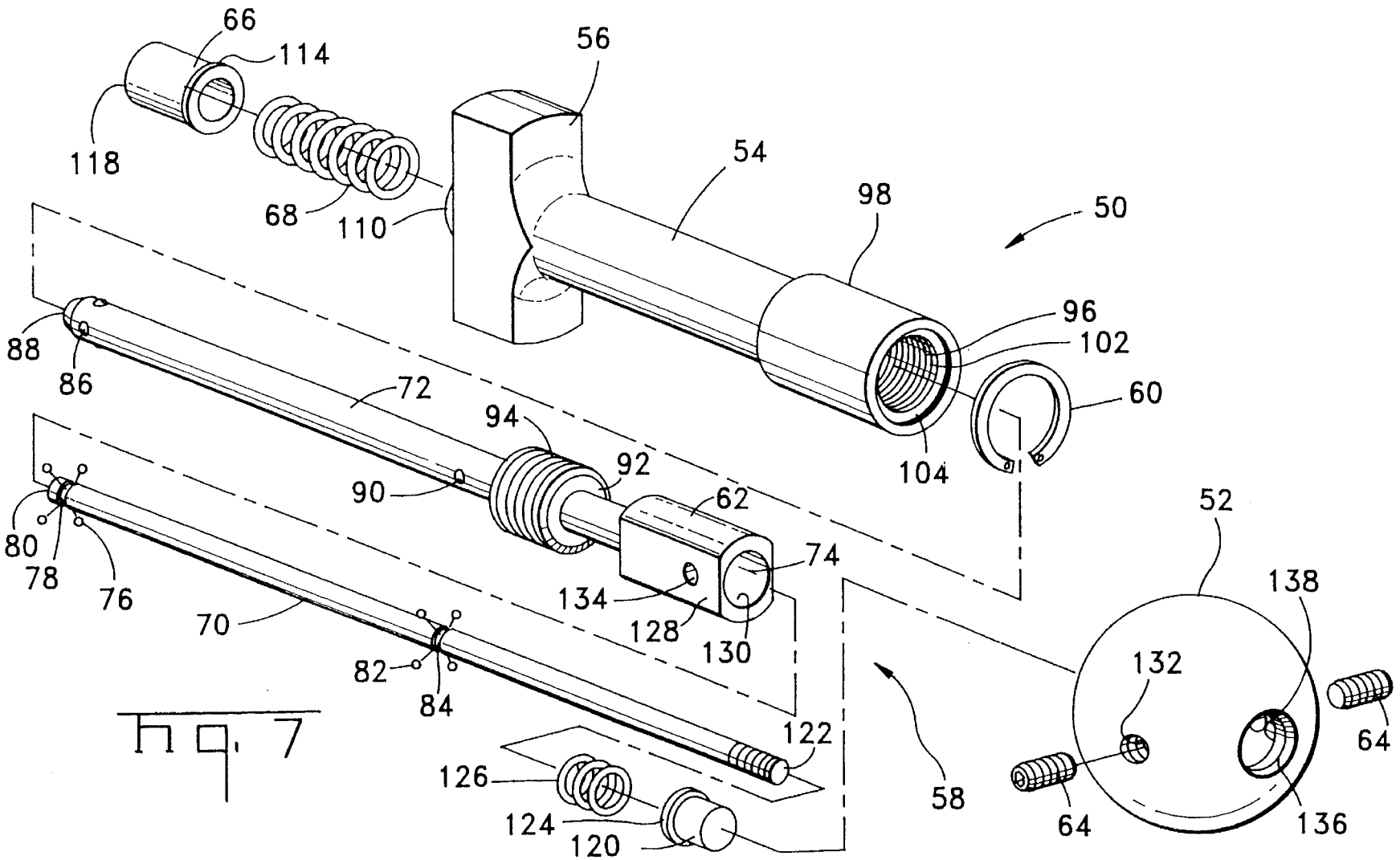

FIGS. 4 to 6 illustrate generally the operation of the operating mechanism 50 of the present invention in mating the interfaces of fixture assembly 10 with receiver assembly 150, utilizing an acme screw mechanism 100. In FIG. 4, the mating face of fixture assembly 10 is placed adjacent the mating face of receiver assembly 150 with alignment posts 34 of frame 20 of fixture assembly 10 generally aligned with alignment apertures of receiver assembly 150 (FIG. 3) and the forward end of the operating mechanism aligned with receptacle 182. A forward portion of subassembly 58 extends beyond the leading end of outer barrel 54 and through central frame aperture 24 to a forward end beyond mating face 30. In FIG. 5, the forward end of the operating mechanism enters receptacle 182 as leading ends of alignment posts 34 enter the corresponding alignment apertures and connectors 12 are moved adjacent to connectors 152 of receiver assembly 150, with frame 20 still being spaced from frame 160. The forward end of ball capture sleeve 66 abuts entrance 174 of receptacle 182 causing ball capture sleeve 66 to retract from the leading end of subassembly 58, permitting the panel locking system of the present invention to engage and releasing the internal locking system permitting the subassembly to be rotated within outer barrel 54.

In FIG. 6, the handle 52 is rotated in a first direction (clockwise) to rotate the subassembly and activating acme screw mechanism 100, causing the outer barrel 54 to be moved relatively forwardly to urge frame 20 toward and to frame 160 and connectors 12 to mate with connectors 152 and terminals 16 and 156 thereof to enter into electrical engagement.

Figure 7:
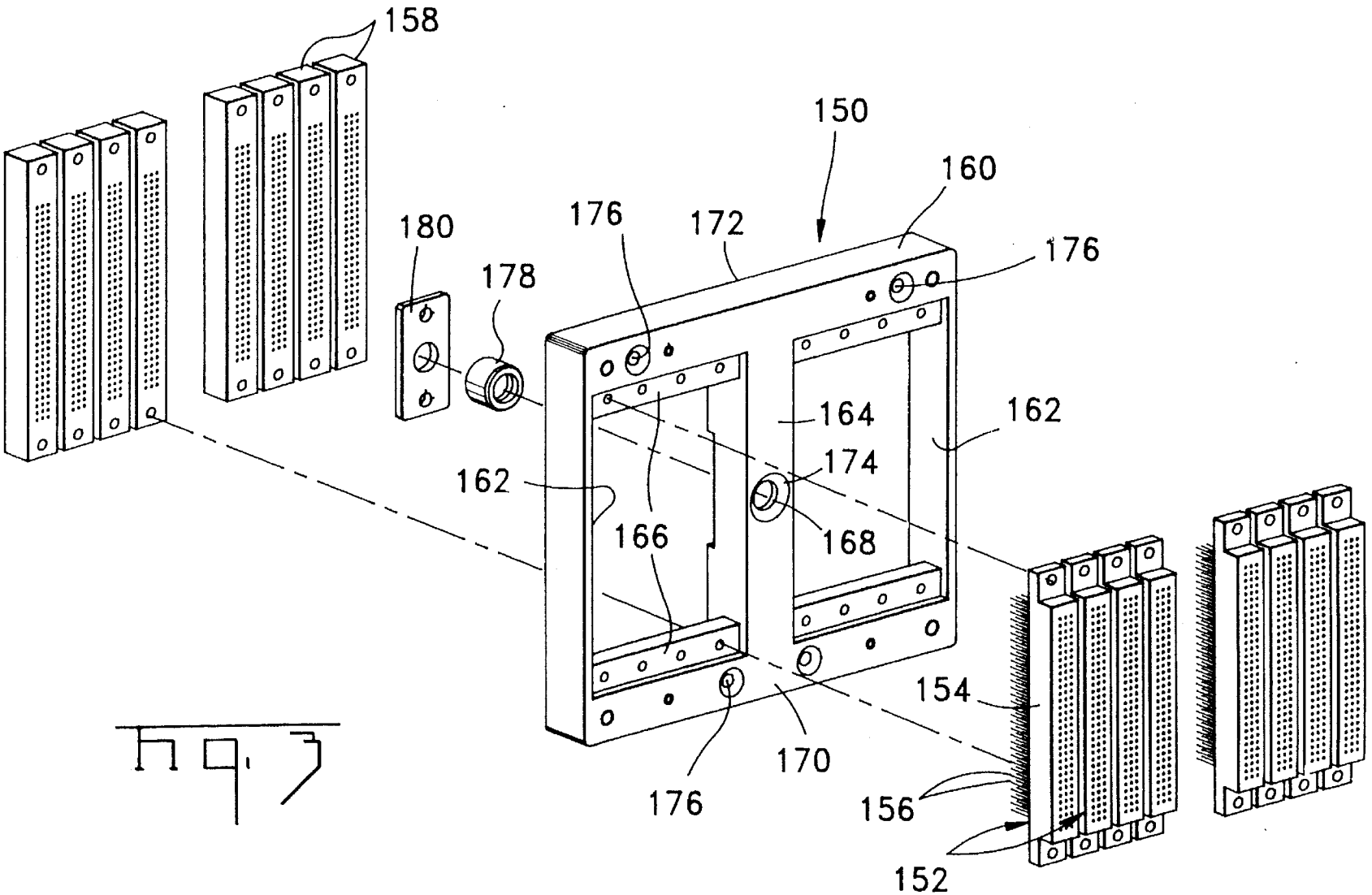
FIG. 7 is a fully exploded view of the operating mechanism of the present invention.

Referring now to FIG. 7, subassembly 58 includes a central shaft 70 within an inner barrel 72, in a bore 74 thereof. A first plurality or array of first locking balls 76 are associated with a forward or first annular groove 78 at a leading or work end 80 of central shaft 70, and a second plurality or array of second locking balls 82 are associated with a rearward or second annular groove 84 of central shaft 70. Forward apertures 86 are defined into leading or work end 88 of inner barrel 72, associated with respective first locking balls 76, and are in communication with bore 74. Rearward apertures 90 are defined in inner barrel 72 rearwardly from forward apertures 86 and are associated with second locking balls 82.

Between rearward apertures 90 and rearward section 62 is an acme screw section 92 that operates in cooperation with elongate acme nut section 98 at the rearward end of outer barrel 54 to move subassembly 58 axially with respect to outer barrel 54 as will be hereinafter explained. Acme screw section 92 of inner barrel 72 includes an outer surface 94 threaded to complement and cooperate with threaded inner surface 96 of acme nut section 98 of outer barrel 54, together defining an acme screw mechanism 100. During assembly of operating mechanism 50, inner barrel 72 is insertable into outer barrel 54 at rearward end 102 thereof into bore 104, and secured to outer barrel 54 with C-clip 60 seated within circumferential groove 106 adjacent rearward end 102 of outer barrel 54 and disposed around inner barrel 72 between acme screw section 92 and rearward section 62. Circumferential groove 106 for C-clip 60 is precisely positioned for C-clip 60 to define a rearward stop for acme screw section 92 of inner barrel 72 with respect to acme nut section 98 of outer barrel 54 during activation of acme screw mechanism 100. A rearwardly facing ledge 108 is formed by a reduced diameter portion of bore 104 of outer barrel 54 to define an ultimate forward stop for the acme screw mechanism. Preferably, acme screw mechanism 100 is designed such that full mating of the electrical connectors occurs prior to ledge 108 becoming engaged.

Outer barrel 54 extends forwardly of mounting flanges 56 to a leading end 110 insertable into central aperture 26 in cross bar 24 of frame 20, with aperture 26 coaxial with the bore of outer barrel 54. Ball capture sleeve 66 is movably mounted to fixture assembly 10 at leading end 110 to extend through central aperture 26 and smaller diameter section 112 thereof, and extends beyond cross bar 24 to be insertable into tapered entrance 174 of receptacle 182 of receiver assembly 150. During mating of fixture assembly 10 with receiver assembly 150 and upon engagement with entrance 174, ball capture sleeve 66 becomes urged to move rearwardly into the bore of outer barrel 54. An enlarged bore portion of outer barrel 54 inwardly from leading end 110 contains compression spring 68, and collar 114 at the rearward end of sleeve 66 has a larger diameter than the ledge defined at reduced diameter forward end 116 of smaller diameter section 112 of central aperture 26, thus retaining sleeve 66 securely fixture assembly 10 and trapping spring 68 within outer barrel 54 around the forward section of inner barrel 72 and between the rearward end of ball capture sleeve 66 and a forwardly facing ledge defined along the inner surface of the bore of outer barrel 54 rearwardly of leading end 110. Upon assembly, ball capture sleeve 66 is urged by spring 68 to extend normally beyond leading end 110 of outer barrel 54 to forward sleeve end 118 when the fixture and receiver assemblies are unmated.

A release button 120 is threaded onto the threaded rearward end 122 of central shaft 70 to form an exposed section to be depressed to move central shaft 70 forwardly. Release button 120 includes an annular flange 124 at its forward end associated with a shaft biasing mechanism such as a compression spring 126. Spring 126 and release button 120 are disposed in a housing section 128 of rearward section 62 of subassembly 58 (the rearward portion of inner barrel 72), in an enlarged rearward portion 130 of bore 74. Handle 52 is securable to rearward section 62 by set screws 64 forced through holes 132 of handle 52 and into corresponding holes 134 of rearward section 62, at least one of which is tapped. Release button 120 is urged by spring 126 outward through button exit 136, until flange 124 abuts shoulder 138 surrounding button exit 134, with spring 126 abutting the bottom of the enlarged bore portion 130 in housing section 128.

FIGS. 8 to 11 are enlarged views of the work end of the operating mechanism 50 of the present invention in cooperation with the receptacle 182 of the receiver assembly 150. In FIG. 8, the leading end of the subassembly 58 is about to be inserted into receptacle 182 and contains first locking balls 76 trapped in forward annular groove 78 of central shaft 70 and respective forward apertures 86 of inner barrel 72. Receptacle 182 is shown to have entrance 174, confining section 184 and circumferential groove 186 defining the panel locking site.

In FIG. 9, the work end of operating mechanism 50 arrives at the entrance of receptacle 182, with the forwardly and outwardly facing surface of frustoconical forward end 118 of ball capture sleeve 66 abutting tapered surface 174. In FIG. 10, the leading ends 80,88 of central shaft 70 and inner barrel 72 continue into receptacle 182 as ball capture sleeve 66 is restrained at entrance 174. First locking balls 76 disposed partially in forward annular groove 78 and partially in forward apertures 86 continue past confining section 184 and arrive at circumferential groove 186. In FIGS. 10 and 11, rearward movement of central shaft 70 by the compression spring in the handle of the operating mechanism causes angled side wall 140 of forward annular groove 78 to urge first locking balls 76 radially outwardly through forward apertures 86 and partially into circumferential groove 186 of receptacle 182 at the panel locking site.

Figure 12:
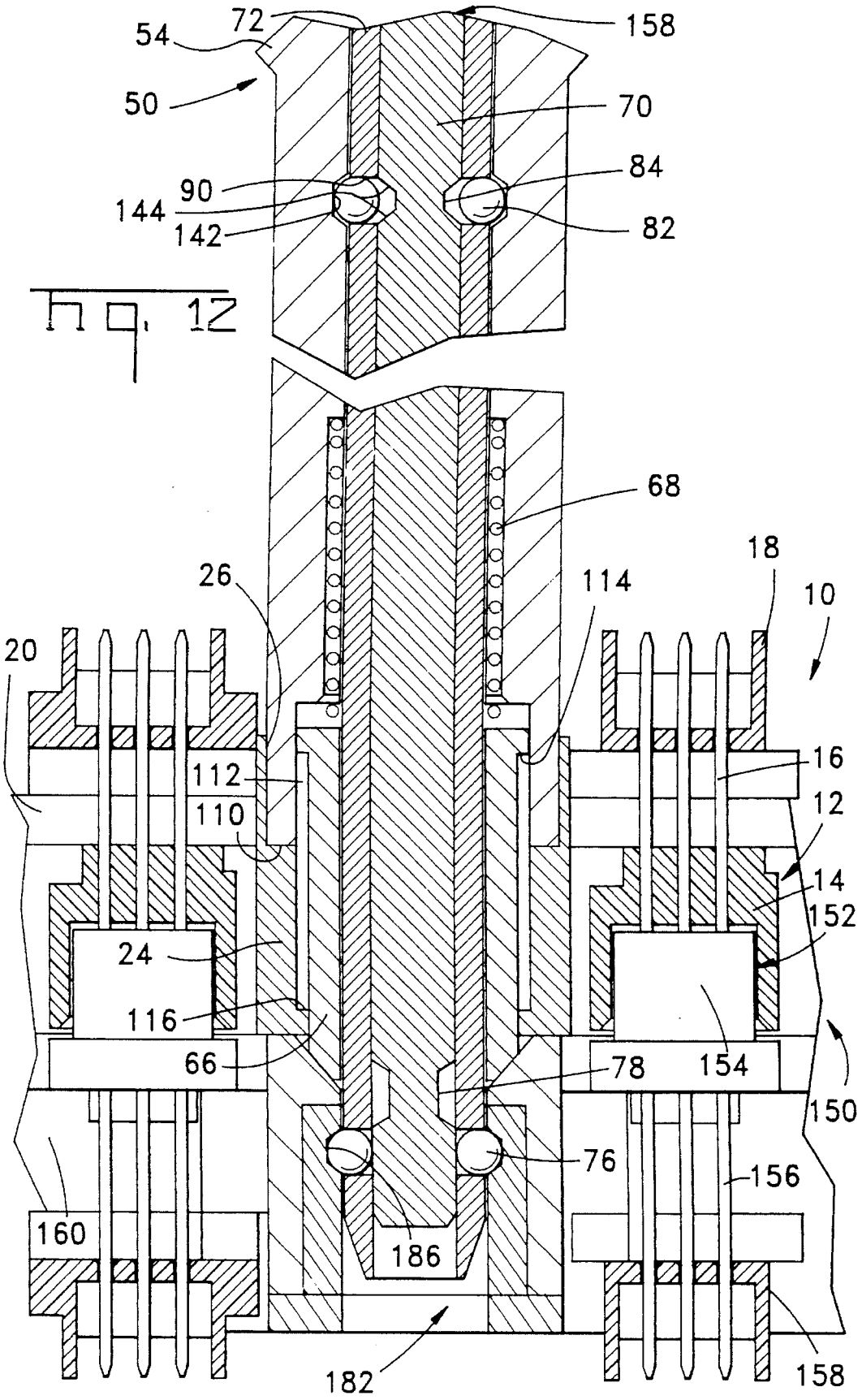
FIG. 12 is an enlarged longitudinal section view of the operating mechanism of the fixture assembly of FIGS. 1 to 7.
Figure 13:
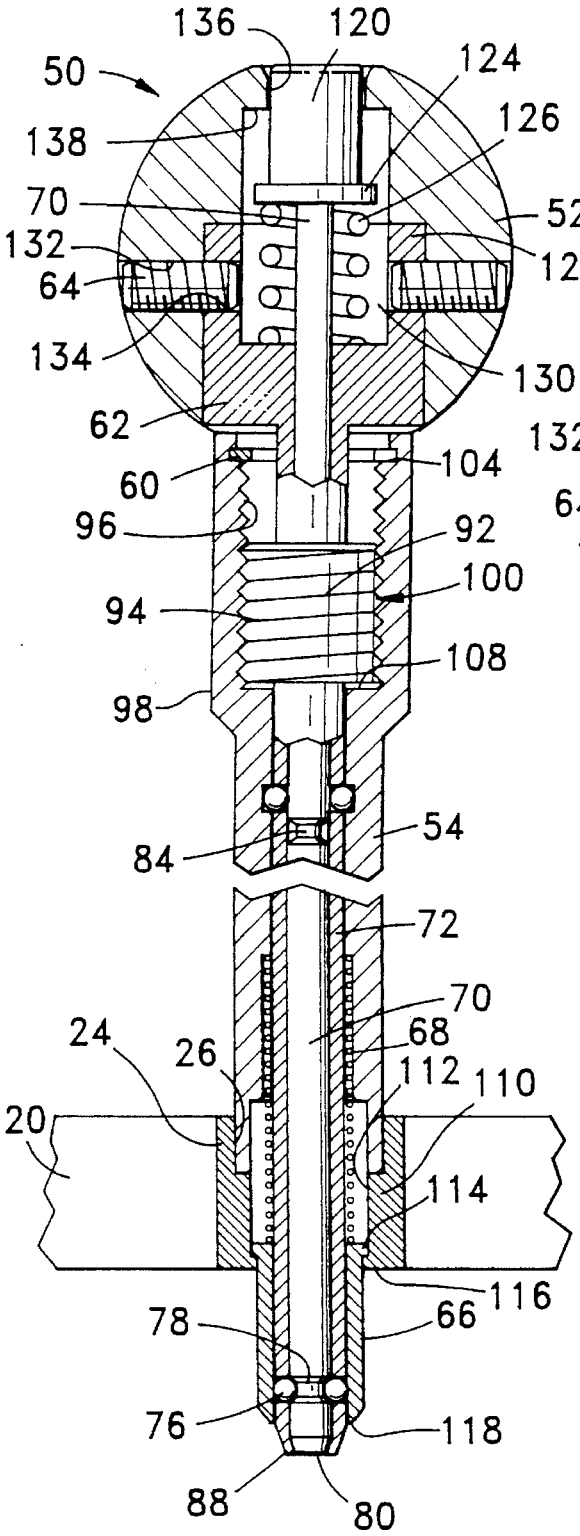
FIGS. 13 and 14 are longitudinal section views of the operating mechanism of the present invention illustrating the unactuated and actuated states thereof.
Figure 14:
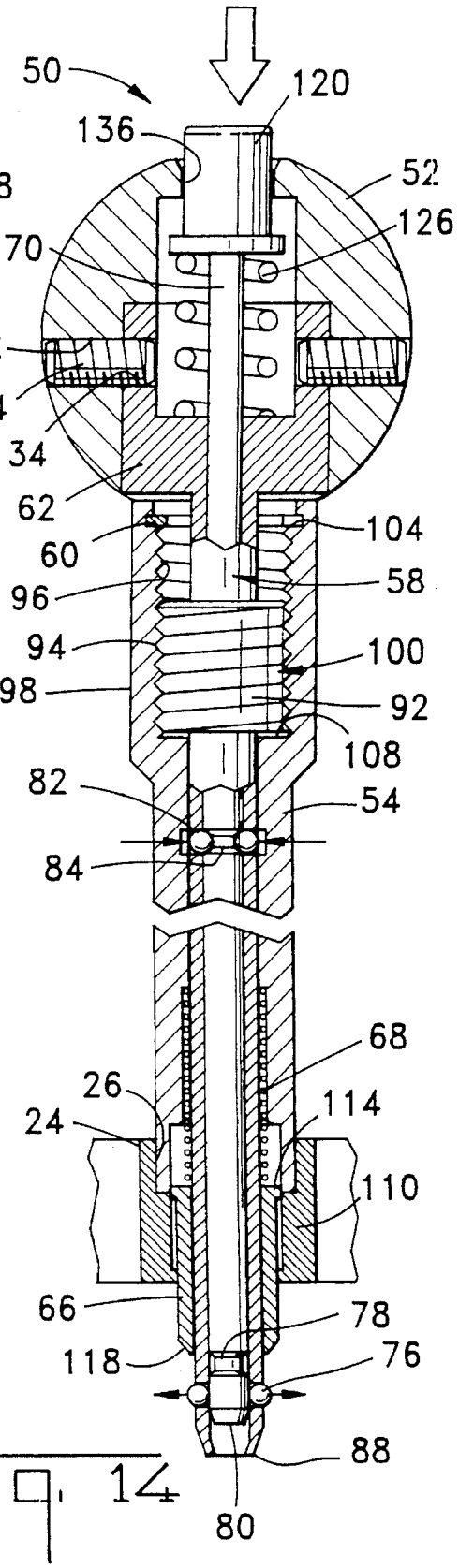

FIG. 12 illustrates that the work end of the operating mechanism must be fully inserted into receptacle 182 and in the panel locking position to permit unlocking of the subassembly for rotation within outer barrel 54. FIG. 13 shows the operating mechanism in the internally locked position, and shows ball capture sleeve 66 retaining first locking balls 76 in place in forward annular groove 78. FIG. 14 shows ball capture sleeve 66 upon being retracted within outer barrel 54 and frame aperture 26, permitting central shaft 70 to be urged rearwardly by compression spring 126 in handle 52, moving rearward annular groove 84 to become aligned with circumferential groove 142 in outer barrel 54 where second locking balls 82 were located in their internally locked position. Annular grooves 78,84 are spaced axially apart a selected distance less than the axial distance between forward and rearward apertures 86,90 of inner barrel 72 so that only one of the annular grooves is aligned with its associated locking balls at any one point in time, assuring that one of the panel locking system or the internal locking system is continually in an activated or locked state.

FIG. 15 illustrates the relationship of first locking balls 76, forward annular groove 78 of central shaft 70, forward apertures 86 of inner barrel 72 and circumferential groove 186 of receptacle 182. The unlocked condition, with first locking balls 76 withdrawn into forward annular groove 78, is shown in phantom. FIG. 15 also illustrates the almost identical relationship of second locking balls 82, rearward annular groove 84 of central shaft 70, rearward apertures 90 of inner barrel 72 and circumferential groove 142 of outer barrel 54. Side walls of receptacle circumferential groove 186 and outer barrel circumferential groove 142 may be angled partially radially inwardly to facilitate inward movement of the locking balls.

In FIGS. 16 and 17 is illustrated a preferred method of trapping each of the first and second locking balls 76,82 securely in position in subassembly 58. With central shaft moved so that the respective annular groove is displaced from being adjacent a ball 76,82 and the general outer surface of central shaft 70 acting as a support or anvil, and with the ball protruding partially outwardly from a respective aperture 86A, 90A of inner barrel 72, a tool such as a punch 200 is struck against the outer surface of inner barrel 72 at a site of a ball 76,82. The end face 202 of the tool's work end is concavely shaped to correspond to the ball's surface. As the tool's end face 202 strikes the metal around the periphery of as-yet unswaged entrance of aperture 86A, 90A, it deforms the metal thereof at 87,91 to swage it against the surface of the ball outwardly of the ball's widest dimension, where it remains to permanently reduce the diameter of the aperture's periphery to less than that of the ball and thus to prevent the ball from exiting the thus-swaged entrance of aperture 86B,90B. The swaging process allows the ball to move radially inwardly along the aperture to partially enter an annular groove of the central shaft once moved axially into alignment therewith, for the ball to become recessed entirely within the outer surface of the inner barrel and permitting the outer surface of the inner barrel to move either along the inner surface of the outer barrel or the confining section 184 of the receptacle (FIG. 10) as the subassembly is being moved axially.

Referring to FIGS. 12 to 14, with respect to locking of the fixture assembly 10 to receiver assembly 150, first locking balls 76 of the first array are assembled partially in forward annular groove 78 of central shaft 70 adjacent leading end 80 thereof and partially within respective forward apertures 86 through the leading end 88 of inner barrel 72. First locking balls 76 are initially held in place within respective forward apertures 86 of inner barrel 72 by ball capture sleeve 66 therearound mounted to leading end 110 of outer barrel 54 and around leading end 88 of inner barrel 72. Ball capture sleeve 66 extends from leading end 110 of outer barrel 54 and is spring biased by compression spring 68 to a forward position covering forward apertures 86 of the inner barrel, and covering and retaining the first locking balls mostly in forward apertures 86 and partially in forward annular groove 78 of central shaft 70, and is urgeable to a rearward position within frame aperture 26 and the outer barrel bore, compressing spring 68.

Insertion of the work end of operating mechanism 50 into receptacle 182 of receiver assembly 150 brings the forwardly facing surface of forward end 118 of ball capture sleeve 66 into abutment with the tapered surface 174 defining the entrance to receptacle 182. Further insertion causes receptacle 182 to urge ball capture sleeve 66 rearwardly into outer barrel 54 from its spring biased forward position. Retraction of ball capture sleeve 66 into the outer barrel exposes the plurality of first locking balls 76 outwardly just as leading end 80 of central shaft 70 enters confining section 184 of receptacle 182 that closely surrounds inner barrel 72 at forward apertures 86, continuing to maintain the first locking balls totally within their respective forward apertures and forward annular groove 78. Confining section 184 has an axial dimension sufficient to permit receipt of a substantial portion of alignment posts 74 into alignment apertures 176 to transversely adjust the position of fixture assembly 10 with respect to receiver assembly 150 to assure connector alignment prior to mating.

Continued insertion of the leading ends of inner barrel 72 and central shaft 70 fully into receptacle 182 causes forward apertures 86 and forward annular groove 78 and first locking balls 76 therein to be moved axially to become aligned with a circumferential groove 186 in the inner surface of receptacle 182 that defines the panel locking site. Within handle 52 of the operating mechanism, compression spring 126 applies force on central shaft 70 continuously urging central shaft 70 rearwardly with respect to inner barrel 72, and upon alignment of first locking balls 76 with the receptacle circumferential groove 186 an angled side surface 140 of forward annular groove 78 of central shaft 70 cams the first locking balls radially outwardly into circumferential groove 186 of receptacle 182 until first locking balls 76 are positioned mostly in the respective forward apertures 86 of inner barrel 72 and protruding outwardly partially in receptacle circumferential groove 186 and entirely out of the central shaft's forward annular groove 78 as can be seen in FIG. 15, thus permitting rearward movement of the central shaft 70.

Locking and unlocking of the subassembly 58 of operating mechanism 50 with respect to outer barrel 54, involves a second plurality or array of second locking balls 82 disposed near the rearward ends of inner and outer barrels 72,54 at the interior locking site. In the locked condition of the operating mechanism, second locking balls 82 are disposed mostly in respective rearward apertures 90 of inner barrel 72 and protruding outwardly partially outwardly in circumferential groove 142 into the inner surface of outer barrel 54 when rearward annular groove 84 is aligned with rearward apertures 90. Such outward protrusion of second locking balls 82 into circumferential groove 142 prevents relative axial movement of subassembly 58 with respect to outer barrel 54 and effectively prevents rotational movement of inner barrel 72 with respect to outer barrel 54 resulting from actuation of acme screw mechanism 100. Movement of the central shaft rearwardly within inner barrel 72 by compression spring 126, when permitted to be so moved by exiting of first locking balls 76 from forward annular groove 78 at leading end 80, causes rearward annular groove 84 of central shaft 70 to move into alignment with rearward apertures 90 through inner barrel 72. Upon alignment of rearward annular groove 84 with rearward apertures 90, second locking balls 82 move radially inwardly partially into rearward annular groove 84 and exiting from circumferential groove 142 of outer barrel 54 as axial movement of subassembly 58 is caused by actuation of acme screw mechanism 100, as can be seen in phantom in FIG. 15. Once second locking balls 82 exit circumferential groove 142 of outer barrel 54, inner barrel 72 is free to move axially when rotated with respect to outer barrel 54 by manual rotation of handle 52 in a first or clockwise direction.

With subassembly 58 locked to receptacle 182 against any axial movement with respect to receiver assembly 150, rotation of inner barrel 72 in the first or clockwise direction causes outer barrel 54 to be cammed forwardly by threads of threaded inner surface 96 of acme nut section 98 thereof following grooves of threaded outer surface 94 of acme screw section 92 of inner barrel 72, comprising the acme screw mechanism 100. Relative forward movement of outer barrel 54 moves frame 20 of fixture assembly 10 carrying connectors 12, thus moving terminals 16 thereof into mated engagement with associated terminals 156 of connectors 152 of receiver assembly 150.

Summarizing the principles of the operating mechanism of the present invention, first locking balls 76 must be completely out of forward annular groove 78 and partially in circumferential groove 186 of the receptacle in order for rearward annular groove 84 to be moved axially into alignment with second locking balls 82 disposed in rearward apertures 90 and circumferential groove 142 of outer barrel 54. Thus first locking balls 76 must be in the panel locking position at the panel locking site in order for rearward annular groove 84 to permit second locking balls 82 to exit circumferential groove 142 of outer barrel 54 to unlock the subassembly 58 for manual rotation of subassembly 58 within outer barrel 54. After unlocking the internal locking system, acme screw mechanism 100 can be activated by rotation of handle 52 to fully mate connectors 12 of fixture assembly 10 with connectors 152 of receiver assembly 150.

For removing fixture assembly 10 from receiver assembly 150, the handle is first rotated in the opposite or counterclockwise direction activating the acme screw mechanism to move the outer barrel and hence the frame 20 and connectors 12, rearwardly with respect to inner barrel 72 locked to receptacle 182 of receiver assembly 150. Rotation is continued until acme screw section 92 abuts C-clip 60 and circumferential groove 142 is aligned with rearward apertures 90 and second locking balls 82. Release button 120 is brought into an extended position protruding from handle 52 and may then be depressed, axially moving central shaft 70 toward receiver assembly 150, with angled side wall 144 of rearward annular groove 84 forcing second locking balls 82 radially outwardly through rearward apertures 90 and into circumferential groove 142 of outer barrel 54, and relocating forward annular groove 78 forwardly until it is aligned with the panel locking site and first locking balls 76 that are disposed in forward apertures 86 and receptacle circumferential groove 186. First locking balls 76 are then received radially inwardly into forward annular groove 78 and exit from circumferential groove 186, unlocking fixture assembly 10 from receiver assembly 150.

Such fixture and receiver assemblies can accommodate pluralities of connectors of differing designs, shapes and high pin counts. The frames of both the fixture and receiver assemblies may be aluminum; preferably the material used for tubular member 178 containing circumferential groove 186 of receptacle 182 and for locking balls 76 and 82 is hardened metal such as heat treated steel to be rugged and durable, and that central shaft 70 containing grooves 78 and 84, inner barrel 72 and outer barrel 54 are of stainless steel. The operating mechanism can be expected to provide a long-term in-service life of up to 100,000 cycles of fixture-receiver mating.

Variations and modifications to the specific embodiment disclosed herein, may be made that are within the spirit of the invention and the scope of the claims.

We claim:

1. An operating mechanism for providing mechanical advantage for mating and unmating a first assembly to a second assembly at a separable interface for mating complementary arrays of electrical connectors thereof, comprising:

a receptacle defined within a transverse frame of said second assembly and defining a panel locking site, an outer housing firmly affixed to a transverse frame of said first assembly and extending rearwardly therefrom, and a subassembly secured within a bore of said outer housing and selectively movable axially and rotationally therewithin and extending from an actuating section forwardly to a leading end extending beyond a leading end of said outer housing and beyond a mating face of said first assembly for insertion into said receptacle, with an internal locking site defined within said outer housing rearwardly from said leading end of said subassembly;

a panel locking mechanism proximate said leading end of said subassembly cooperable with said receptacle at said panel locking site upon full insertion thereinto prior to mating of said connectors to lock said subassembly against axial movement with respect to said receptacle, thereby assuredly securing said first assembly to said second assembly;

an internal locking mechanism in said subassembly cooperable with said outer housing to lock said subassembly to said outer housing against axial movement with respect thereto, said internal locking mechanism adapted to be released upon locking of said panel locking mechanism; and a screw mechanism defined between said outer housing and said subassembly adapted to move said subassembly with respect to said outer housing between first and second positions when said internal locking mechanism is unlocked upon rotation of said actuating section in first and second directions respectively, whereby full insertion of the subassembly leading end into the receptacle locks the first assembly to the second assembly in an unmated position, simultaneously unlocking the subassembly from the outer housing permitting actuation of the screw mechanism to move the outer housing and the first assembly frame secured thereto relatively rearwardly with respect to the subassembly, thereby drawing the first assembly frame toward and to the second assembly frame and mating the arrays of electrical connectors affixed to the frames.

2. The operating mechanism of claim 1 wherein said actuating section is a manually grippable handle rearwardly of said frame of said first assembly.

3. The operating mechanism of claim 1 wherein said first assembly is a fixture and said second assembly is a receiver, of test equipment for testing electrical or electronic articles.

4. The operating mechanism of claim 1 wherein said outer housing is barrel-shaped.

5. The operating mechanism of claim 1 wherein said subassembly includes a section movable when unlocked between forward and rearward stops with at least said rearward stop being defined by said outer housing.

6. The operating mechanism of claim 5 wherein said rearward stop is defined by a C-clip disposed in an annular seat along an inner surface of said bore of said outer housing rearwardly of said screw mechanism, and said forward stop is defined by a rearwardly facing ledge along said bore inner surface forwardly of said screw mechanism.

7. The operating mechanism of claim 1 wherein said screw mechanism is an acme screw mechanism defined by a threaded outer surface of an acme screw portion of said subassembly cooperating with a threaded inner surface of an acme nut portion of said outer housing coaxial with said bore thereof.

8. The operating mechanism of claim 7 wherein said acme screw portion is rotatable until becoming axially moved into stopping engagement with forward and rearward stops with at least said rearward stop being defined by said outer housing.

9. The operating mechanism of claim 1 wherein said subassembly includes an inner housing firmly affixed to said actuating section and disposed in said bore of said outer housing and selectively axially and rotatably movable therewithin when unlocked, a central shaft disposed within a bore of said inner housing and selectively rotatably movable therewithin and selectively axially movable therewithin when released from a locked condition, said central shaft is in operative engagement with said panel locking system and said internal locking system, said actuating section is affixed to a rearward end of said inner housing rearwardly of a rearward end of said outer housing, and a rearward end of said central shaft extends rearwardly beyond said rearward end of said inner housing to conclude in a section at least exposed at said actuating section to permit selective engagement to move said central shaft relatively axially with respect to said actuating section and said inner housing.

10. The operating mechanism of claim 9 wherein said actuating section includes a biasing mechanism to urge said central shaft from a first axial position to a second axial position when said central shaft is released from a fixed condition with respect to said inner housing upon locking of said panel locking system.

11. The operating mechanism of claim 9 wherein said subassembly includes a first array of first locking balls retained mostly within forward apertures of said inner housing adjacent said leading end thereof and a second array of second locking balls retained mostly within rearward apertures of said inner housing at a selected axial distance rearwardly and remote from said forward apertures, said central shaft includes a forward annular groove associated with said first locking balls and a rearward annular groove associated with said second locking balls and located rearwardly from said forward annular groove a selected axial distance less than said selected axial distance between said forward apertures and said rearward apertures such that when said forward annular groove is aligned with said forward apertures, said second annular groove is axially forwardly from said rearward apertures and said second locking balls are held radially outwardly by said central shaft partially beyond an outer surface of said inner housing for protruding into said circumferential groove of said outer housing and defining an activation of said internal locking system, and when said rearward annular groove is aligned with said rearward apertures, said first annular groove is axially rearwardly from said forward apertures and said first locking balls are held radially outwardly by said central shaft partially beyond an outer surface of said inner housing for protruding into said circumferential groove of said receptacle and defining an activation of said panel locking system.

12. The operating system of claim 11 wherein peripheries of said first and rearward apertures of said inner housing at said outer surface thereof are swaged partially thereover to retain said first and second locking balls mostly therewithin.

13. The operating mechanism of claim 9 wherein said panel locking system comprises an array of first locking balls held mostly within forward apertures of said inner housing at a first axial location proximate said leading end of said subassembly and partially within a forward annular groove of said central shaft and incrementally movable partially outwardly into a circumferential groove in an inner surface of said receptacle defining said panel locking site, when said first locking balls are radially aligned therewith and said first locking balls are released to be moved outwardly, and movement of said first locking balls into said circumferential groove locks said first assembly to said second assembly when said first annular groove of said central shaft is thereafter moved out of alignment with said circumferential groove.

14. The operating mechanism of claim 13 wherein said forward annular groove of said central shaft is defined between groove sidewalls that are partially angled radially outwardly such that movement of said central shaft relative to said inner housing urges said first locking balls radially outwardly, and said circumferential groove of said receptacle is defined between groove sidewalls that are partially angled radially inwardly such that when said first locking balls are partially seated within said circumferential groove, said first locking balls are urged radially inwardly upon movement of said inner housing relative to said receptacle, and movement of said first locking balls into said first annular groove of said central shaft aligned therewith unlocks said first assembly from said second assembly.

15. The operating mechanism of claim 14 wherein said central shaft is biased rearwardly to urge said first locking balls radially outwardly partially into said circumferential groove of said receptacle when said first annular groove becomes aligned with said circumferential groove, and to simultaneously move said central shaft rearwardly to trap said first locking balls partially in said circumferential groove of said receptacle.

16. The operating mechanism of claim 14 wherein said circumferential groove of said receptacle is recessed inwardly from an entrance thereof, said entrance is adapted to be engaged by said leading end of said ball capture sleeve for stopping further forward movement of said ball capture sleeve as said first assembly continues to be moved toward said second assembly, and said receptacle further includes a confining section located between said entrance and said circumferential groove and dimensioned to closely fit around an outer surface of said inner housing at said first axial location prohibiting radially outward movement of said first locking balls until said first axial location of said inner housing is adjacent said circumferential groove, whereafter said first locking balls are released to be moved radially outwardly into said circumferential groove.

17. The operating mechanism of claim 16 wherein said frame of said first assembly includes a plurality of alignment posts protruding forwardly from said mating face of said first assembly and beyond leading ends of said connectors a selected distance, and said frame of said second assembly includes a like plurality of alignment apertures adapted to receive leading ends of said alignment posts thereinto as said first assembly is moved toward said second assembly after said leading end of said subassembly has begun entering said receptacle, and said confining section extends an axial distance sufficient to permit receipt of said alignment posts into said alignment apertures to assure alignment of said connectors of said arrays of said first and second assemblies prior to mating and electrical engagement of contacts of said connectors, whereafter said first assembly becomes locked to said second assembly at said panel locking site, all to protect said connectors and said contacts thereof from damage otherwise possible due to misalignment.

18. The operating mechanism of claim 13 wherein a ball capture sleeve is mounted at the leading end of said outer housing to extend beyond said mating face of said first assembly to a leading end forwardly of said first axial location of said first locking balls, and concluding just rearwardly of said leading end of said subassembly, said outer housing leading end being adapted to permit receipt of said ball capture sleeve substantially into said bore thereof during insertion of said subassembly leading end into said receptacle, to release said first locking balls for radially outward movement, and said outer housing forward end further including a biasing mechanism to urge said ball capture sleeve forwardly to cover said first locking balls at said first axial location when said subassembly leading end is withdrawn from said receptacle.

19. The operating mechanism of claim 18 wherein said frame of said first assembly includes an aperture coaxial with said bore of said outer housing at said leading end thereof, a forward portion of said subassembly extends beyond said leading end of said outer housing and through said frame aperture, said ball capture sleeve extends movably through said frame aperture and beyond said mating face of said first assembly to surround said forward portion when said subassembly leading end is withdrawn from said receptacle, a reduced diameter portion of said aperture at said mating face is engaged within said aperture by a collar of said ball capture sleeve when at a forwardmost axial position thereof, and a compression spring is trapped within said bore of said outer housing between a rearward end of said ball capture sleeve and a forwardly facing ledge along said bore of said outer housing spaced rearwardly from said forward end thereof, to continuously bias said ball capture sleeve forwardly to assuredly cover said forward apertures of said inner housing when said first assembly is withdrawn from said second assembly.

20. The operating mechanism of claim 9 wherein said internal locking system comprises an array of second locking balls held mostly within respective rearward apertures of said inner housing at a selected axial location rearwardly and remote from said leading end of said subassembly and partially within a circumferential groove in an inner surface of said outer housing defining an internal locking site, and incrementally movable partially inwardly into a rearward annular groove of said central shaft when said second locking balls are radially aligned therewith and said second locking balls are released to be moved inwardly.

21. The operating mechanism of claim 20 wherein said rearward annular groove of said central shaft is defined between groove sidewalls that are partially angled radially outwardly such that when said second locking balls are seated partially in said rearward annular groove, movement of said central shaft relative to said inner housing urges said second locking balls radially outwardly, and said circumferential groove of said outer housing is defined between groove sidewalls that are partially angled radially inwardly such that when said second locking balls are partially seated within said circumferential groove and said rearward annular groove of said central shaft is aligned therewith, said second locking balls are urged radially inwardly partially into said rearward annular groove upon axial movement of said subassembly relative to said outer housing, when said actuation section is rotated actuating said screw mechanism and axially moving said subassembly rearwardly relative to said outer housing, all to move said first assembly toward and to said second assembly to mate said connectors.

22. The operating mechanism of claim 21 wherein said subassembly includes a biasing mechanism for biasing said central shaft is biased rearwardly to move said central shaft rearwardly after said first assembly is locked to said second assembly by said panel locking system, for said rearward annular groove to become aligned with said circumferential groove of said outer housing, effectively unlocking said subassembly for rotation thereof by rotation of said actuating section.

23. The operating mechanism of claim 22 wherein rotation of said actuating section in an opposed second direction moves said subassembly relatively forwardly with respect to said first assembly and moving said first assembly from mated engagement with said second assembly and also re-aligning said circumferential groove of said outer housing with said rearward apertures of said inner housing and said rearward annular groove containing said second locking balls, whereafter said central shaft is axially movable toward said second assembly by depression of said exposed section at said actuating section, thereby urging said second locking balls radially outwardly partially into said circumferential groove of said outer housing and releasing said central shaft for further axial movement toward said second assembly.

24. The operating mechanism of claim 23 wherein said exposed section of said central shaft is a button secured thereto to protrude through a button exit of said actuating section and therebeyond when said central shaft is in its rearwardmost axial position relative to said inner housing.

25. The operating mechanism of claim 24 wherein a compression spring is disposed and biased between an inner end of said button and a rearwardly facing ledge within said actuating section, biasing said central shaft rearwardly with respect to said inner housing.

* * * * *